US007374445B2

(12) United States Patent
Gouzien et al.

(10) Patent No.: US 7,374,445 B2
(45) Date of Patent: May 20, 2008

(54) SHIELDED ELECTRICAL HARNESS WITH AN ANGLED CONNECTOR, AND ITS METHOD OF FABRICATION

(75) Inventors: Pascal Gouzien, Bouc Bel Air (FR); Stephane Giraud, Gignac la Nerthe (FR)

(73) Assignee: Eurocopter, Marignane cedex (FR)

( * ) Notice: Subject to any disclaimer, the term of this patent is extended or adjusted under 35 U.S.C. 154(b) by 0 days.

(21) Appl. No.: 11/723,607

(22) Filed: Mar. 21, 2007

(65) Prior Publication Data

US 2007/0224852 A1 Sep. 27, 2007

(30) Foreign Application Priority Data

Mar. 23, 2006 (FR) ..... 06 02553

(51) Int. Cl.
*H01R 4/38* (2006.01)

(52) U.S. Cl. ..... 439/320; 439/456; 439/932

(58) Field of Classification Search ..... 439/320, 439/449, 455–456, 460, 470, 932
See application file for complete search history.

(56) References Cited

U.S. PATENT DOCUMENTS 3,546,658 A 12/1970 Van Horssen et al.
4,310,213 A 1/1982 Fetterolf, Sr. et al.
5,399,808 A * 3/1995 Carter et al. ..... 174/80
6,089,874 A 7/2000 Kroulik et al.
6,602,090 B2 * 8/2003 Kato ..... 439/455
7,201,603 B1 * 4/2007 Finona ..... 439/446

FOREIGN PATENT DOCUMENTS

DE 2444358 7/1980
DE 42 01 390 7/1993

* cited by examiner

*Primary Examiner*—Khiem Nguyen
(74) *Attorney, Agent, or Firm*—Young & Thompson

(57) ABSTRACT

A bundle includes wire segments forming a branch fitted with an angled coupling including:

a base having the ends of the wire segments fastened thereto;

an angled rigid casing surrounding the wire segments and having a first end providing for bearing against the base; and a member for fastening the casing to the base with a mutual variable orientation;

the branch is protected by a shielding sheath secured to a second end of the casing; the bundle includes an abutment member secured to the portion of the wire segments extending inside the angled casing and co-operating with the angled casing to prevent the portion of the wire segments from leaving the casing; the portion of the wire segments is twisted in such a manner that the mutual orientation between the base and the casing can be modified without introducing harmful mechanical stresses in these wire segment portions.

18 Claims, 3 Drawing Sheets

SHIELDED ELECTRICAL HARNESS WITH AN ANGLED CONNECTOR, AND ITS METHOD OF FABRICATION

The present invention relates to a shielded electrical harness having an angled connector, and to a method of fabricating such a harness.

FIELD OF THE INVENTION

The technical field of the invention is that of fabricating electrical harnesses for fitting to rotorcraft.

BACKGROUND OF THE INVENTION

Numerous electrical or optical bundle systems fitted with connectors have already been proposed.

U.S. Pat. No. 1,565,321 describes a flexible electrical cord comprising a fabric sheath and a flexible protective sleeve of rubber overmolded thereon.

U.S. Pat. No. 4,006,956 describes a wire-passing device for connecting a plug or a microphone to a cable having a plurality of conductors; the device comprises a disk pierced by an opening through which the cable extends, a heat-shrink sleeve surrounding the disk and a portion of the cable, and extending through an opening in the housing of the plug; the conductors are of a length such that they are not fully stretched, so that traction exerted on the cable leads to stress inside the housing of the plug rather than in the connections of the conductors to the plug.

U.S. Pat. No. 4,629,275 describes a device for making a connection between a cable and a connector, the device comprising a flexible tubular body made of braided non-metallic filaments; the body is secured to the cable by an adhesive heat-shrink sleeve and also to the connector in order to limit the stresses in the connection.

European patent No. 1 191 639 describes an angled connector fitted to a bundle of optical or electrical cables.

The present invention relates more particularly to a bundle or harness comprising a plurality of electrically conductive wire segments, each wire segment being coated in an electrically insulating material, the wire segments being grouped together to form a branch of the bundle that is fitted at its free end with an angled coupling comprising:

- a base (or plug) having the ends of said wire segments of the branch of the bundle secured thereto;
- an angled rigid casing (or duct) surrounding the wire segments and having a first end designed to bear against the base; and
- a member for fastening the casing on the base with the mutual orientation therebetween being variable.

The invention applies to this type of bundle in which at least the branch fitted with the connector is protected by a shielding sheath or braid that is generally made of metal and not very deformable, and that is secured to a second end of the angled casing or duct.

The base is for plugging into a corresponding part of a complementary (second) connector belonging to a second bundle or to a piece of equipment, in order to provide electrical continuity between the pins of the two connectors.

For this purpose, the two connectors must be in alignment, and they must therefore extend with a certain determined mutual orientation.

In particular when the second connector forms part of equipment in a rotorcraft and/or is rigidly secured to a wall of the rotorcraft, mutual engagement of the connectors requires the angled connector of the bundle to be at an orientation that corresponds to that of the second connector; the rigidity of the shielded bundle can impede or prevent the angled connector it carries being oriented; in some configurations it is possible to loosen the member that fastens the casing to the base, change the mutual orientation of the casing and the base, and then retighten the fastener member; nevertheless, the amplitude of this change in orientation is limited; such a modification also runs the risk of subjecting one or more of the conductors to unacceptable levels of mechanical stress.

OBJECTS AND SUMMARY OF THE INVENTION

That is the problem that the invention seeks to satisfy.

A particular object of the invention is to propose a shielded electrical harness fitted with an angled connector, and a method of fabricating it, that are improved and/or that remedy, at least in part, the shortcomings or drawbacks of known harnesses.

In an aspect of the invention, there is provided a harness or bundle having one or more abutment members secured to the wire segment portion extending inside the angled casing or duct, said abutment member(s) co-operating with the angled casing to prevent said wire segment portion from leaving the casing. In addition, this wire segment portion is twisted so that the mutual orientation of the base and the casing can be modified without introducing harmful mechanical stresses to these wire segment portions.

In another aspect of the invention, there is provided a method of fabricating such a harness, the method comprising the following steps:

- fitting the portion of the wire segments extending inside the angled casing or duct with at least one abutment member suitable for co-operating with the angled casing in order to prevent said portion of the wire segments from leaving the casing;
- twisting said wire portions extending between the abutment(s) and the base; for this purpose, the base is turned in a predetermined orientation that can subsequently be modified during assembly on a rotorcraft, such changes in orientation causing localized twisting of the wire segments between the abutment(s) and the base, without applying stress to said wire segments because of said wire segments possessing extra length; and then
- securing the angled casing to the base by means of the fastener member forming part of the connector.

BRIEF DESCRIPTION OF THE DRAWINGS

Other aspects, characteristics, and advantages of the invention appear from the following description which refers to the accompanying drawings and which relates, without any limiting character, to preferred embodiments of the invention.

MORE DETAILED DESCRIPTION

In FIGS. 1 to 7, the angled portion of the connector and the ring for securing to the base are shown diagrammatically in section view in order to reveal more clearly the components and the component portions that extend inside these two parts.

Figure 7:
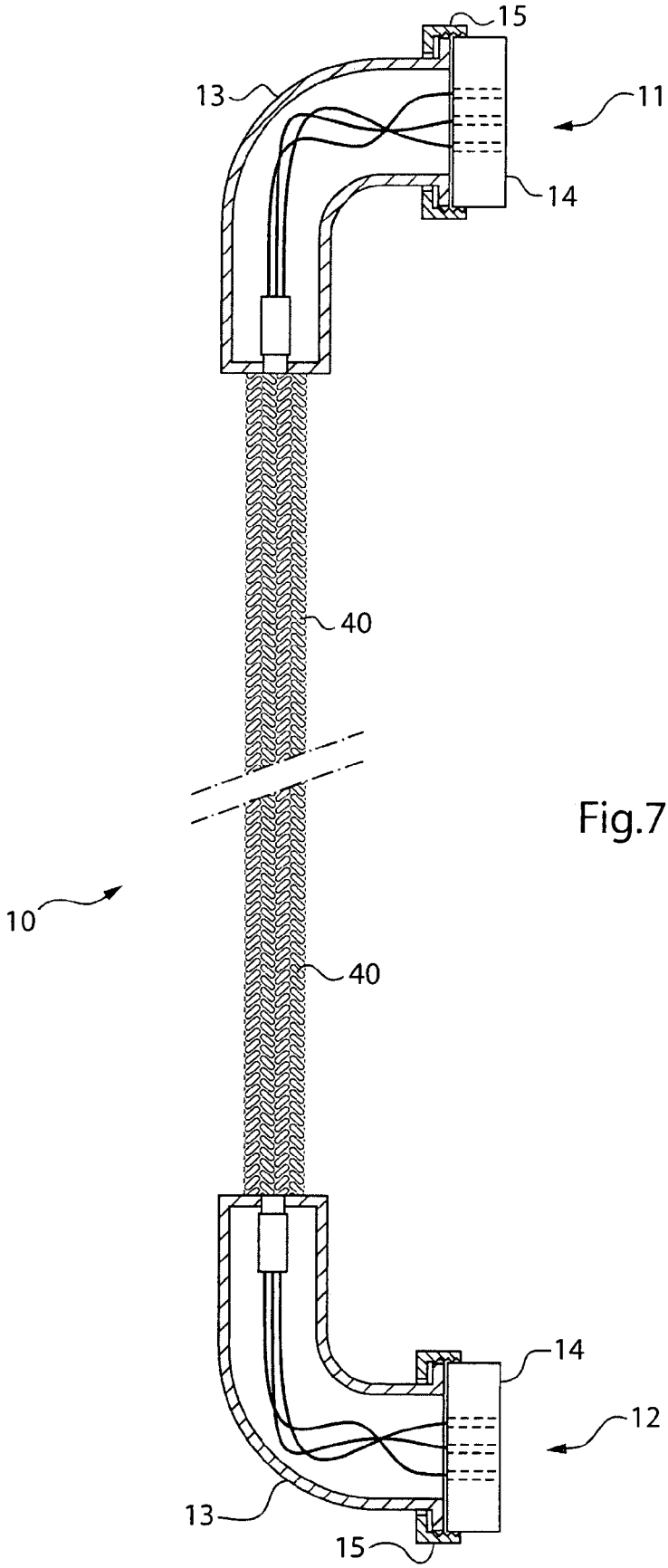
FIG. 7 shows a harness of the invention obtained by the method.

The harness 10 shown in FIG. 7 presents a single branch that is fitted at each of its two ends with an angled connector 11, 12 and that is provided with shielding 40.

Figure 5:
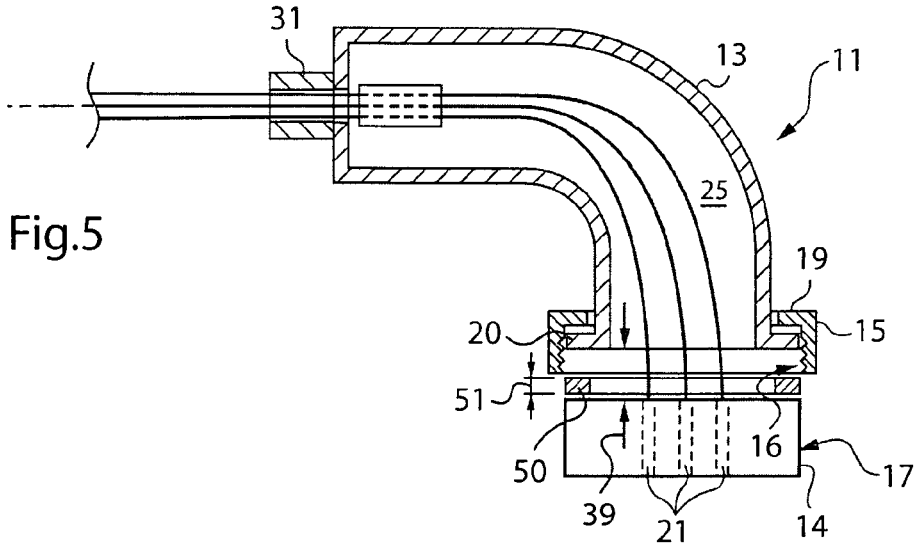
Figure 6:
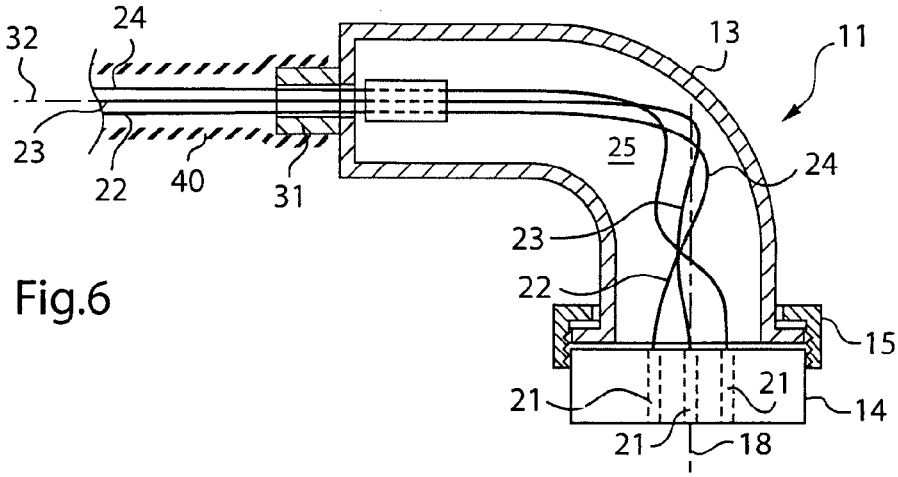

The connector 11 in FIGS. 5 to 7 comprises an angled casing 13, a base 14, and a ring 15 serving to fasten the casing 13 to the base 14 in releasable manner.

For this purpose, the ring 15 presents a female thread 16 on its inside face that is designed to co-operate with a male thread of complementary shape and size that is provided on the outside face 17 of the base 14; the male thread is not shown in order to keep the figures clear; thus, this fastening is obtained by engaging the threaded portions in one another, and by causing the two parts 14 and 15 to turn relative to each other about an axis 18 corresponding substantially to an approximate axis of symmetry of these two parts.

During this screw fastening, a bearing surface 19 (in the form of an annular collar) of the ring 15 comes to bear against the complementary bearing surface 20 (likewise in the form of an annular collar) of the angled casing 13, until the part 13 is pressed by the collar 20 against the base 14.

The base 14 is pierced by three channels 21 (FIGS. 5 and 6), respectively for receiving the ends of three conductors 22 to 24 of the harness; these ends are secured, by crimping or soldering, for example, to pins (male or female) that are engaged in these channels 21.

Figure 1:
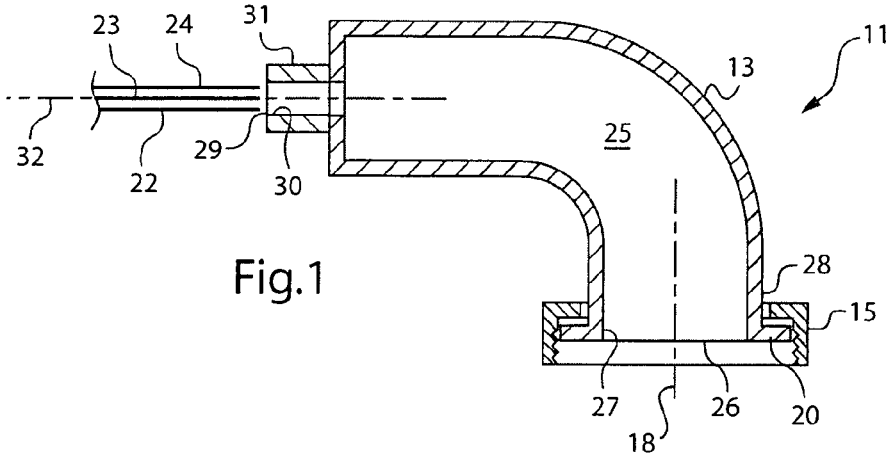
FIGS. 1 to 6 shows successive steps in a method of fabricating a harness in accordance with the invention, the figures being diagrammatic fragmentary section views showing one end of a branch of a harness that is to be fitted with an angled connector, the section being in a plane containing the longitudinal axis (reference 32) of the wires in said branch.

As can be seen from FIG. 1 in particular, the casing 13 defines an angled cavity 25 that opens out firstly via a first opening 26 provided in a wall 27 situated at a first end 28 of the casing 13, and secondly via a second opening 29 provided in a wall 30 situated at a second end 31 of the casing 13.

In particular, the second end 31 is in the form of a cylindrical sleeve extending along an axis 32, and the first end is also in the form of a cylinder of axis 18, and it is terminated by the collar 20, the axes 18 and 32 generally being coplanar without being parallel (nor do they coincide).

Figure 2:
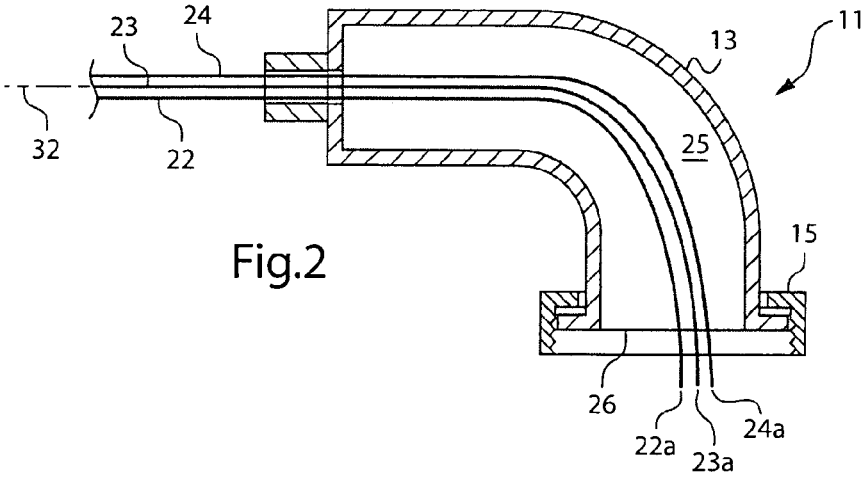
Figure 3:
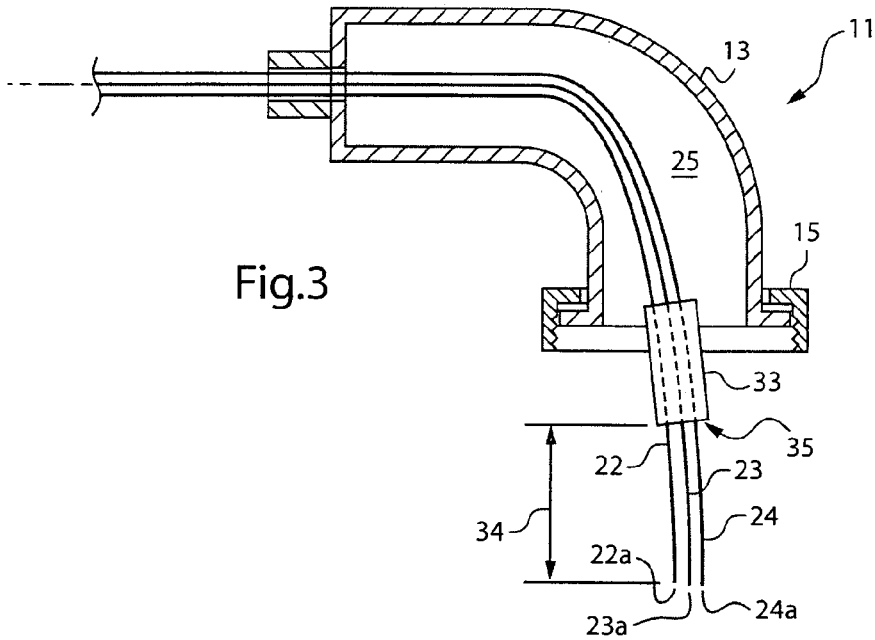
Figure 4:
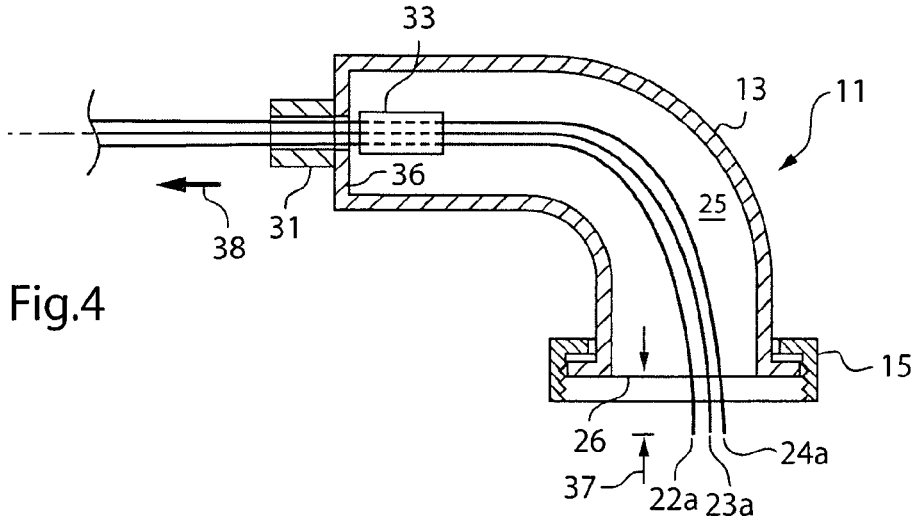

With reference to FIGS. 1 and 6 in particular, fabrication of the harness comprises the following operations in succession:

i) introducing (FIG. 1) conductors 22 to 24 into the cavity 25 via the orifice 29 (second opening);

ii) continuing this introduction until the ends 22*a*, 23*a*, and 24*a* of the conductors leave the cavity 25 via the first opening 26 (FIG. 2);

iii) engaging (FIG. 3) an adhesive tie 33 and/or a heat-shrink tubular sleeve around the conductors 22 to 24, and then tightening (FIG. 4) so as to tie these conductors together; this operation is performed while taking care to conserve a length 34 for the conductor wires 22 to 24, said length being measured between their ends 22*a* to 24*a* and the distal end 35 of the sleeve 33, that is sufficient to ensure that when the sleeve 33 is brought into abutment (FIG. 4) against a wall 36 of the end 31 of the casing 13, by sliding the conductors in the direction of arrow 38, the conductors presenting portions that project from the opening 26 by a length 37 that allows the ends 22*a* to 24*a* to be inserted into pins introduced into the channels 21 of the base 14 (FIG. 5), while retaining for these conductors, portions of length 39 (FIG. 5) that is sufficient to enable them to twist inside the cavity 25 after they have been fixed to the pins of the base, and without imparting any significant mechanical stress to the conductors;

iv) the ends 22*a* to 24*a* are secured to the pins fitted to the base 14, and then the conductors are pulled, along arrow 38, FIG. 4, until the sleeve 33 comes into abutment against the wall 36;

v) an annular spacer 50 of calibrated thickness 51 equal to the extra length 39 is introduced between the base 14 and the casing 13 while the braid is being put into place (following step) so as to guarantee that this extra length is complied with;

vi) an electromechanical shielding braid 40 surrounding the conductors 22 to 24 is then secured to the end 31 of the angled casing 13. By way of example, this connection can be made in the manner described in French patent No. 2 711 850 and U.S. Pat. No. 5,558,539;

vii) the spacer of calibrated thick-ness is withdrawn;

viii) the portions of wire extending between the sleeve and the base are twisted; this twisting can be performed in particular by causing the base 14 to turn with said ends 22*a* to 24*a* connected thereto about the axis 18 through an amplitude of about 90° to 180° or more, so that the base 14 has the same orientation as the second connector with which it is to be engaged; and ix) the base 14 is secured to the casing 13 by screwing the ring 15.

Thus, the mutual orientation between the base 14 and the angled casing 13 can be modified at any time, by about plus or minus 90° to 180°.

For this purpose, it suffices to unscrew the ring 15 to separate the parts 13 and 14, which corresponds to the configuration shown in FIG. 5; thereafter, the mutual orientation is modified by causing the base 14 to turn relative to the casing 13 about the axis 18, through plus or minus 180°, for example; thereafter the connection ring 15 can be screwed back on.

During this change of orientation, the conductors are prevented from moving significantly relative to the end 31 of the casing 13 by the sleeve 33 bearing against the plane abutment 36.

What is claimed is:

1. A bundle (10), comprising:

a branch made up of a plurality of conductor wire segments (22, 23, 24) coated with an insulating material and grouped together;

an angled coupling surrounding at least a portion of the branch, the angled coupling having an angled rigid casing (13) connected to a base (14) via a fastener member (15);

channels extending through said base;

a first terminal end of each of the wire segments secured to the channels;

a first end of the branch fitted to the angled coupling, the angled rigid casing (13) surrounding the wire segments and having a first end (20, 28) designed to bear against the base;

the fastener member (15) for releasably fastening the first end of the casing to the base, said fastener member having a first mode wherein said base is rotatable relative to said casing about an axis through the first end of the casing, and a second mode wherein said base is fixedly secured to said casing;

a shielding sheath (40) enclosing a second end of the branch, an end of the sheath secured to a second end (30, 31) of the casing opposite the first end, a portion of the wire segments of the branch extending from the end of the sheath inside the casing so that the casing (13) surrounds the wire segments; and an abutment member (33) secured to the portion of the wire segments that extend inside (25) the casing at a position on the wire segments where the portion of the wire segments enters the casing from the end of the sheath, the abutment member adhered to at least one of the wire segments, said abutment member co-operating with the second end of the casing to prevent said portion of the wire segments from leaving said casing, and wherein said portion of the wire segments presents an extra length (39) within the casing sufficient to enable the wire segments to twist about each other so that an angular orientation between the base and the casing about the axis through the first end can be modified without introducing harmful mechanical stresses in the wire segment portions surrounded by the casing.

2. A bundle according to claim 1, in which the abutment member comprises a sleeve.

3. A bundle according to claim 2, in which the sleeve is a heat-shrink sleeve.

4. A bundle according to claim 1, in which the abutment member surrounds all of the wire segments.

5. A bundle according to claim 1, in which the extra length of the wire segments enable an angular orientation between the base and the casing to be modified by at least 90° to an approximate maximum of 180°.

6. A bundle according to claim 1, in which the shielding sheath (40) is made at least in part out of metal.

7. A bundle according to claim 1 in which the fastener member (15) for fastening the casing to the base comprises a threaded ring.

8. A method of fabricating a harness or bundle according to claim 1, comprising the steps of:

fitting the portion of the wire segments extending inside the casing through the abutment member;

twisting said wire portions extending between the abutment and the base, the base being angularly positioned in a predetermined orientation with said casing; and then securing the casing to the base by means of the fastener member.

9. A method according to claim 8, further comprising the step of:

tightening the abutment member around the wire segments in order to secure the wire segments together while ensuring that a length (34) of the wire segments measured between the end of each of the wire segments (22*a* to 24*a*) and a distal end (35) of the abutment member is sufficient to ensure that, when the abutment member is in abutment against a wall (36) at the second end (31) of the casing (13), the extra length of the wire segments in the casing (13) is sufficient to enable the end of each of the wire segments to be inserted into pins introduced in the channels (21) of the base while conserving for these each of the wire segments a length portion (39) that is sufficient to enable the wire segments to twist about each other as a result of turning the base relative to the first end of the casing.

10. A bundle (10), comprising:

an angled coupling;

a plurality of conductor wire segments grouped together to form a branch;

a free end of the branch connected to the coupling;

the coupling comprising a hollow, rigid casing having a first opening at a first end, a wall at a second end opposite the first end with a second opening extending therethrough, and a bending portion between the first end and the second end;

a base having channels extending therethrough;

a fastener member at the first end configured to releasably secure said base to said casing;

an abutment member, having a width greater than a width of the second opening, configured to be secured around the plurality of wire segments, wherein, said fastener member has a first mode wherein said base is rotatable with said casing about an axis through a center of the first opening, and a second mode wherein said base is fixedly secured to said casing, the wire segments extend through the second opening into the casing and through the abutment member at the second opening by an extra length, an end of each wire segment is secured to one of the channels extending through said base, and the extra length of the wire segments in the casing is sufficient for the wire segments to twist about each other in response to a rotation of the base about the axis through the center of the first opening up to a maximum angular displacement without introducing mechanical stresses in the wire segments harmful to the wire segments.

11. A bundle according to claim 10, wherein the abutment member comprises a sleeve.

12. A bundle according claim 11, wherein the sleeve is a heat-shrink sleeve.

13. A bundle according to claim 10, wherein the extra length is such that the maximum angular displacement is 90°.

14. A bundle according to claim 10, wherein the extra length is such that the maximum angular displacement is 180°.

15. A bundle according to claim 10, wherein, the fastener member comprises a threaded ring rotatable about the axis through the center of the first opening.

16. A bundle according to claim 1, wherein the casing is formed as a single part.

17. A bundle according to claim 10, wherein the casing is formed as a single part.

18. A bundle according to claim 10, further comprising:

a shielding sheath enclosing the branch extending outside the casing, wherein the sheath is secured to the second end of the casing.

* * * * *